US011684826B1

(12) United States Patent
Romanelli

(10) Patent No.: US 11,684,826 B1
(45) Date of Patent: Jun. 27, 2023

(54) HANDS FREE GOLF BALL WASHER

(71) Applicant: John Romanelli, Acushnet, MA (US)

(72) Inventor: John Romanelli, Acushnet, MA (US)

( * ) Notice: Subject to any disclaimer, the term of this patent is extended or adjusted under 35 U.S.C. 154(b) by 368 days.

(21) Appl. No.: 17/101,275

(22) Filed: Nov. 23, 2020

(51) Int. Cl.
*A63B 47/04* (2006.01)
*A63B 57/00* (2015.01)

(52) U.S. Cl.
CPC ..... *A63B 47/04* (2013.01); *A63B 57/00* (2013.01)

(58) Field of Classification Search
CPC ..... A63B 47/04; A63B 57/00
See application file for complete search history.

(56) References Cited

U.S. PATENT DOCUMENTS 6,745,424 B1 * 6/2004 Pimentel ..... A63B 57/60 15/21.2
10,286,262 B1 * 5/2019 Yost ..... A63B 57/60
2011/0302730 A1 * 12/2011 Grötsch ..... A63B 47/04 15/21.2
2012/0073067 A1 * 3/2012 Borgese ..... A63B 47/04 15/105
2016/0184660 A1 * 6/2016 Arnold ..... A63B 47/04 15/88.1

* cited by examiner

*Primary Examiner* — Michael D Jennings
(74) *Attorney, Agent, or Firm* — Gulf Coast Intellectual Property Group

(57) ABSTRACT

A golf ball washer that is configured to be located on a golf course wherein the present invention allows a golfer to clean their golf ball without engaging the present invention with their hands. The golf ball washer of the present invention includes a support frame having a support pole member and a base member. The support pole member has a housing secured thereto distal to the base member. The housing is cylindrical in shape and has a hollow interior and further has a first end and a second end. A movement member is rotatably mounted within the interior volume of the housing and is configured to traverse a golf ball through the housing. A drive assembly is secured to the housing and movement member so as to provide rotational movement of the movement member. A foot pedal and drive cable are operably coupled to the drive assembly.

20 Claims, 4 Drawing Sheets

HANDS FREE GOLF BALL WASHER

FIELD OF THE INVENTION

The present invention relates generally to golf accessory equipment, more specifically but not by way of limitation, a hands free golf ball washer that is operable to facilitate the cleaning of a golf ball without the need to engage the washer with one's hands.

BACKGROUND

Golf is a popular sport that is played by millions of people across the world. As is known in the art, golf involves the utilization of various clubs to traverse a golf ball along a course of eighteen holes. Various clubs are utilized at different locations of the golf holes. The traditional golf ball design has been relatively unchanged for years wherein the golf ball maintains its regulation size and has an outer covering that is covered with dimples. The dimples provide control of the golf ball when striking the ball with various golf clubs as well as the flight pattern thereof. As golf is played on an outdoor course the golf ball is subject to various types of terrain. Often the golf ball can be exposed to rough conditions, ground under repair or wet areas wherein the golf ball will accumulate mud/dirt deposits thereon. The accumulation of mud/dirt on the golf ball is undesirable as it has a negative effect on the playability and control of the golf ball.

Golfers will routinely clean their golf ball during the course of a round. Most golf courses have installed in a plurality of locations a golf ball cleaner. The conventional golf ball cleaner is a plunger style device wherein the plunger handle is engaged by a user utilizing their hands. The ball is loaded in an aperture of the plunger handle and is moved in an upwards-downwards direction wherein the golf ball surface is exposed to cleaning bristles in the housing of the washer. Recent virus pandemics have highlighted the need to reduce hand engagement with various items. By way of example but not limitation, many courses require that the golf pin remain in the hole and not be touched by the player. Accessories have been added to assist in either retrieval of the golf ball from the hole of inhibit full penetration of the hole by the golf ball. It is desirable that similar attention to other golf course accessories be considered.

It is intended within the scope of the present invention to provide a hands free golf ball washer wherein a user can facilitate the washing of a golf ball without the need to engage the golf ball washer with their hands.

SUMMARY OF THE INVENTION

It is the object of the present invention to provide a hands free golf ball washer configured to facilitate the cleaning of a golf ball wherein the golf ball washer includes a support frame.

Another object of the present invention is to provide a golf ball washer operable to be placed on a golf course and provide cleaning of a golf ball wherein a user operates with their foot wherein the golf ball washer of the present invention includes a housing movably secured to the top of the support frame.

A further object of the present invention is to provide a hands free golf ball washer configured to facilitate the cleaning of a golf ball wherein the housing includes a cylindrical body having a hollow interior.

Still another object of the present invention is to provide a golf ball washer operable to be placed on a golf course and provide cleaning of a golf ball wherein a user operates with their foot wherein the housing includes a first end and a second end and further includes a first aperture proximate the first end and a second aperture proximate the second end.

An additional object of the present invention is to provide a hands free golf ball washer configured to facilitate the cleaning of a golf ball wherein the housing an auger style blade is disposed within the interior volume of the housing.

Yet a further object of the present invention is to provide a golf ball washer operable to be placed on a golf course and provide cleaning of a golf ball wherein a user operates with their foot wherein the housing is operably coupled to a drive assembly wherein the drive assembly provides control of the auger style blade within the housing.

Another object of the present invention is to provide a hands free golf ball washer configured to facilitate the cleaning of a golf ball wherein the drive assembly includes a cavity having a primary drive wheel disposed therein.

An alternate object of the present invention is to provide a golf ball washer operable to be placed on a golf course and provide cleaning of a golf ball wherein the primary drive wheel is operably coupled to the auger style blade within the housing.

An alternative objective of the present invention is to provide a hands free golf ball washer configured to facilitate the cleaning of a golf ball wherein the support frame further includes a foot pedal proximate the base thereof.

Another object of the present invention is to provide a golf ball washer operable to be placed on a golf course and provide cleaning of a golf ball wherein a user operates with their foot wherein the foot pedal is operably coupled to the drive cable.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
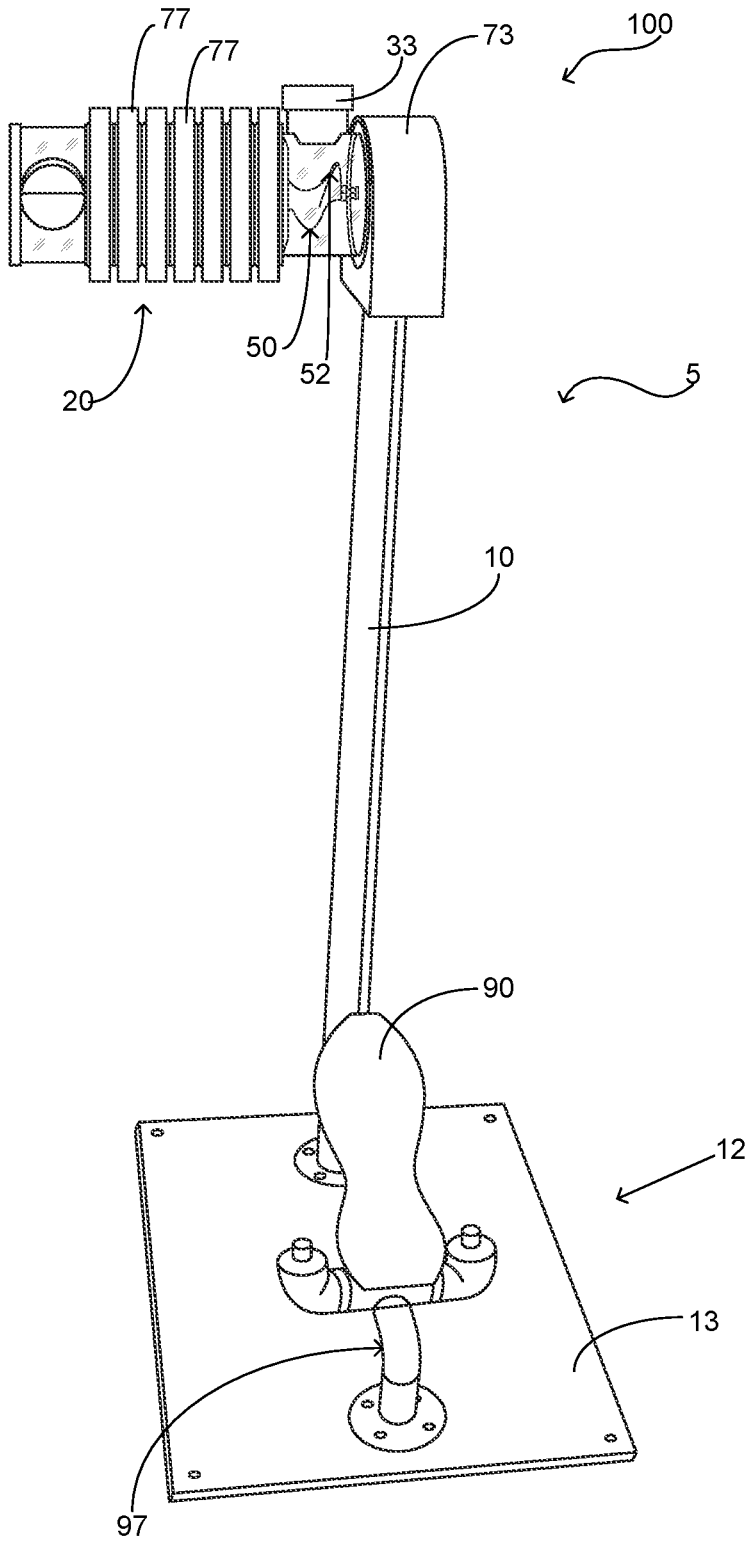
FIG. 1 is a perspective view of the present invention.
Figure 2:
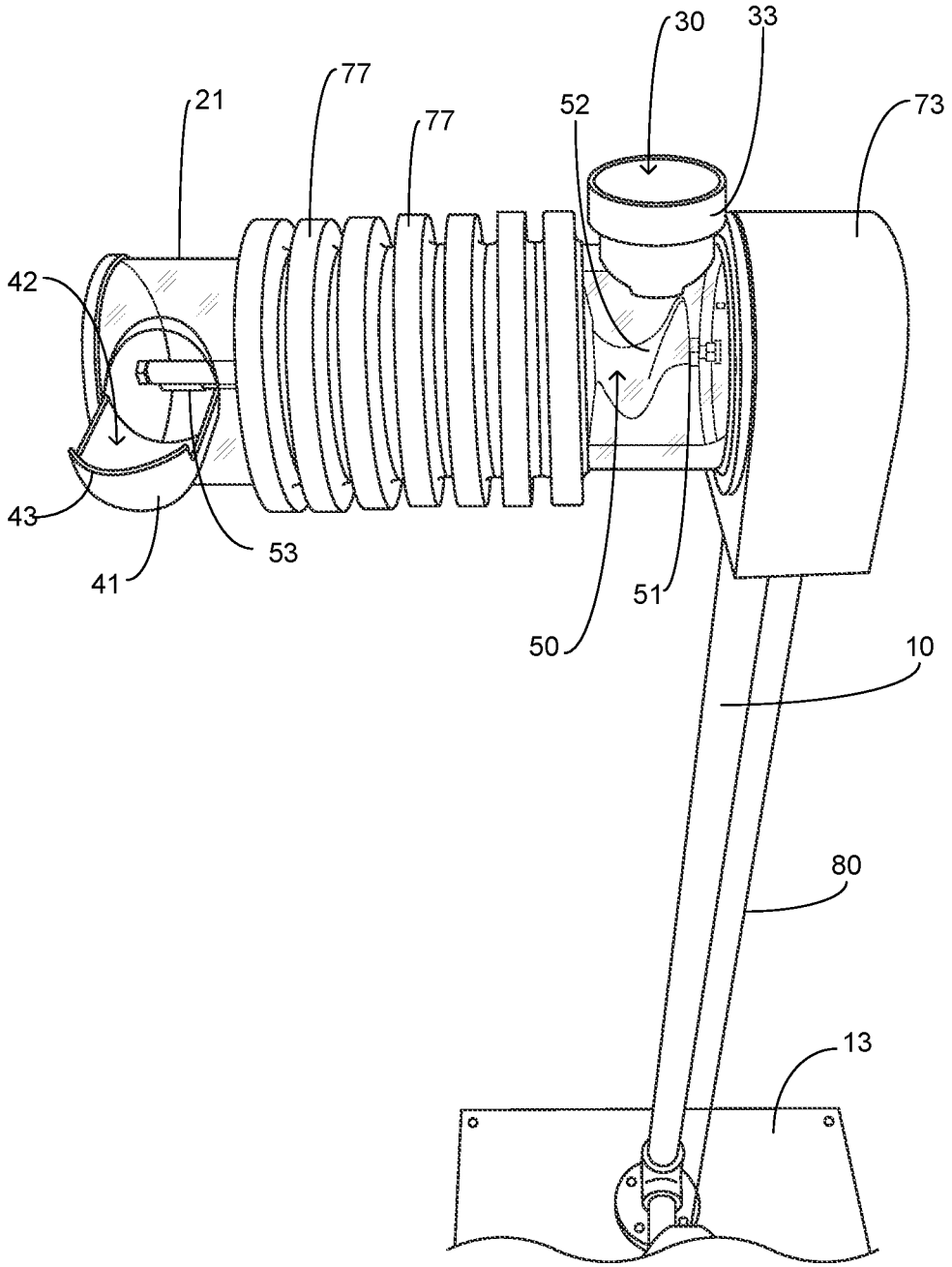
FIG. 2 is a detailed view of the housing and drive assembly.
Figure 3:
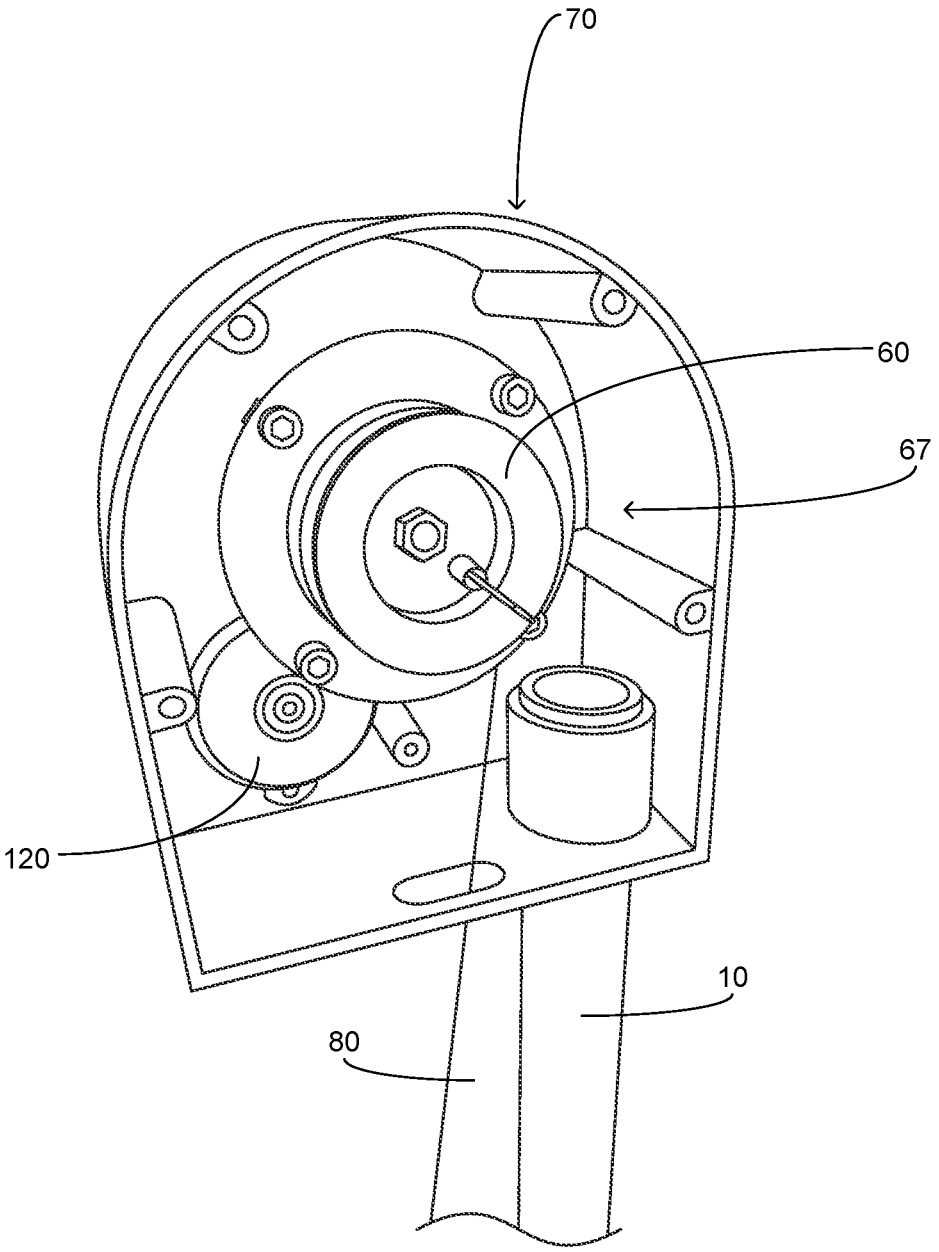
FIG. 3 is a detailed view of the cavity of the drive assembly.
Figure 4:
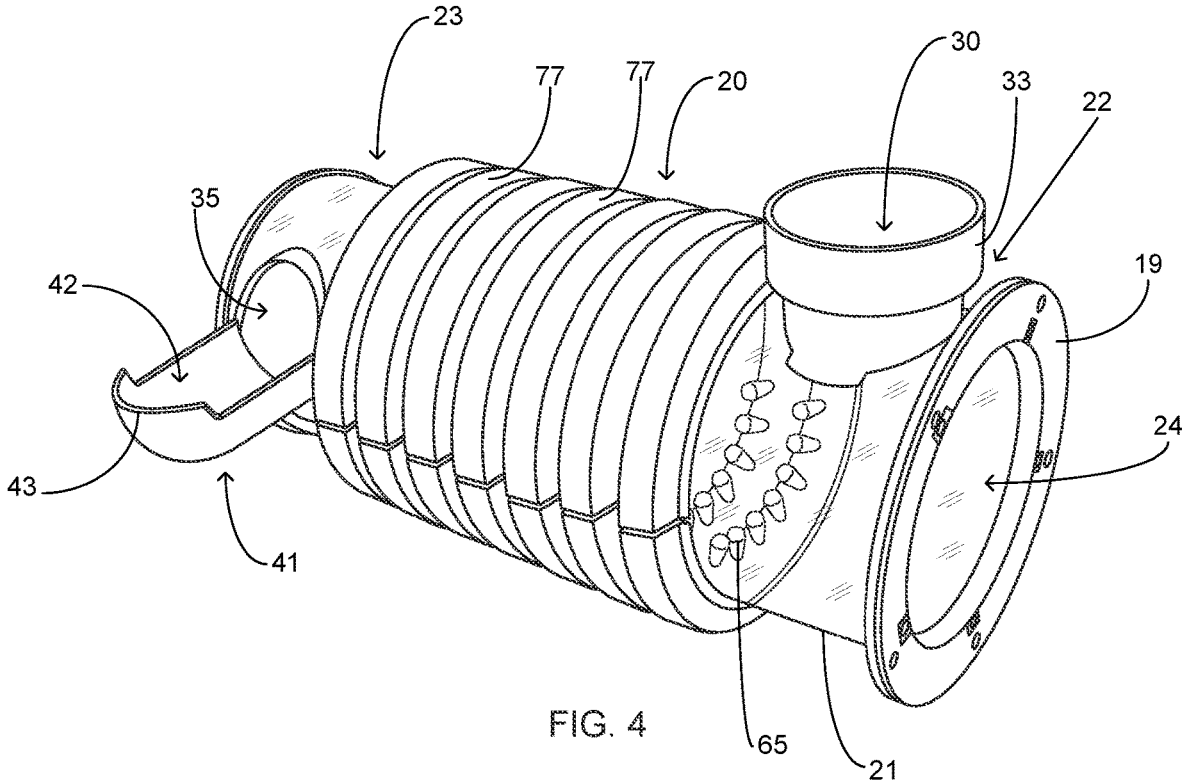
FIG. 4 is a detailed view of the exterior of the housing.
Figure 5:
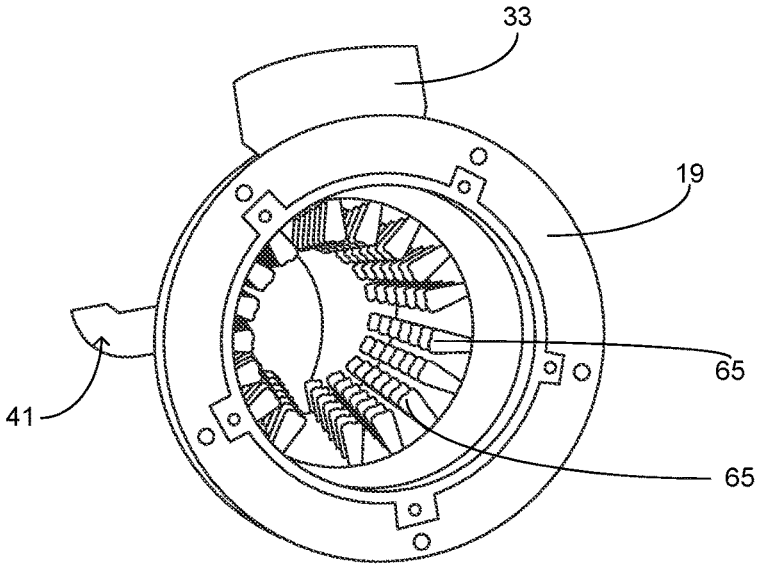
FIG. 5 is a detailed view of the interior of the housing.

References now to the drawings submitted herewith, wherein various elements depicted therein are not necessarily drawn to scale and wherein through the views and figures like elements are referenced with identical reference numerals, there is illustrated a hands free golf ball washer 100 constructed according to the principles of the present invention.

An embodiment of the present invention is discussed herein with reference to the figures submitted herewith.

Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Drawings submitted as a part hereof, the hands free golf ball washer 100 includes a support frame 5. The support pole member 10 is manufactured from a durable rigid material such as but not limited to square metal tubing. The support pole member 10 is secured to the lower portion 12 utilizing suitable techniques and extends upwards therefrom being perpendicular thereto. While a support pole member 10 is in a preferred embodiment is a single pole type structure, it is contemplated within the scope of the present invention that the support frame 5 could be constructed in alternate manners having various quantities of elements. The lower portion 12 includes a base member 13 formed in a shape that creates stability for the hands free golf ball washer 100. The base member 13 is planar in manner and manufactured from a durable heavy material such as but not limited to metal. It is contemplated within the scope of the present invention that the base member 13 could be formed in alternate shapes and sizes in order to achieve the desired objective of providing stability for the hands free golf ball washer 100 so as to inhibit the toppling thereof.

The hands free golf ball washer 100 includes housing 20 wherein the housing 20 is superposed the support pole member 10 distal to the base member 13. The housing 20 is mounted to drive assembly housing 73 via flange 19. Flange 19 is contiguously formed with housing 20 and is sealably secured to drive assembly housing 73 utilizing suitable elements such as fasteners, gaskets or o-rings. The housing 20 is cylindrical in form having an outer wall 21, a first end 22 and a second end 23. The housing 20 is hollow having an interior volume 24 wherein the hollow interior volume 24 extends intermediate the first end 22 and the second end 23. The housing 20 is manufactured from a suitable durable material such as but not limited to plastic. The housing 20 includes a first aperture 30 proximate the first end 22 and a second aperture 35 proximate the second end 23. The first aperture 30 includes extension member 33 wherein the extension member 33 extends the first aperture 30 upward so as to facilitate easier input of a golf ball 99. It should be understood within the scope of the present invention that the extension member 33 could rise above the first aperture 30 in alternate lengths so as to assist a user in introducing a golf ball into the housing 20. It should be further understood within the scope of the present invention that the housing 20 could be formed in alternate lengths and diameters.

The housing 20 has operably disposed in the interior volume 24 thereof a movement member 50. The movement member 50 is a conventionally shaped auger blade that is rotatably mounted within the interior volume 24 of the housing 20. While the movement member 50 is illustrated herein in a preferred embodiment of an auger style blade, it is contemplated within the scope of the present invention that the movement member 50 could be configured in alternate manners in order to achieve the desired objective discussed herein. The movement member 50 consists of a shaft 51 and helical coil 52 contiguously formed therewith wherein the shape of the movement member 50 facilitates the traversal of a golf ball from the first end 22 to the second end 23 as the movement member 50 is rotated. Ensuing a golf ball being deposited into the first aperture 30, the golf ball will travel along the movement member 50 and as such be exposed to cleaning solutions disposed within the interior volume 24 as well as the bristles 65. The movement member 50 has formed thereon a ball ejection member 53. The ball ejection member 53 is planar in manner extending perpendicular from the shaft 51 and functions to assist moving the golf ball into the ball trap member 41. The ball ejection member 53 is positioned and angularly oriented with the shaft 51 and helical coil 52 to achieve the desired objective. It should be understood within the scope of the present invention that the ball ejection member 53 could be formed in alternate shapes and sizes and still achieve the desired objective discussed herein.

The bristles 65 extend inward into the interior volume 24 of the housing 20 so as to ensure contact with a golf ball as the golf ball is traversed through the interior volume 24 on the movement member 50. The bristles 65 are manufactured from a suitable material such as but not limited to plastic. Bristles 65 are secured to bristle support ring members 77 that are configured to circumferentially surround the exterior of the housing 20. The bristle support ring members 77 are formed in equal opposing halves being annular in shape and are configured to be removable so as to facilitate the replacement thereof. It should be understood within the scope of the present invention that the hands free golf ball washer 100 could have the bristles 65 disposed and secured utilizing alternate techniques.

The helical shape of the movement member 50 facilitates the traversal of the golf ball through the housing 20 so as to be ejected via the second aperture 35 into a user's hand. The second aperture 35 is positioned on the housing 20 so as to allow retaining of a cleaning fluid within interior volume 24 proximate the bottom 19 thereof. The second aperture 35 includes a ball trap member 41 that is contiguously formed with the housing 20. The ball trap member 41 is configured to be trough like in shape having a channel 42 operable to receive and retain a golf ball as it exits the second aperture 35. The ball trap member 41 includes stop member 43 that is curved upwards to ensure maintenance of the golf ball within the channel 42 subsequent egressing through the second aperture 35.

The movement member 50 is operably coupled to a drive wheel 60. The drive wheel 60 is disposed within the cavity 67 of the drive assembly 70. The drive wheel 60 is rotatably mounted within the drive assembly 70 utilizing suitable durable techniques. The drive wheel 60 is operably coupled to drive cable 80 wherein the drive cable 80 is further operably coupled to foot pedal 90. Movement of the foot pedal 90 in a downwards direction will result in the extraction of a portion of the drive cable 80 from retention wheel 120. The retention wheel 120 has an additional cable coupled to the drive wheel 60 (not illustrated herein) wherein the cable extending intermediate the retention wheel 120 and drive wheel 60 functions to provide a reverse rotational movement ensuing release of the foot pedal 90. In one embodiment of the hands free golf ball washer 100 the drive cable 80 is circumferentially secured around drive wheel 60 and extends downward to the foot pedal 90. It is contemplated within the scope of the present invention that the drive cable 80 could be operably coupled to the drive wheel 60 utilizing alternate techniques.

As the foot pedal 90 is pushed downwards the drive cable 80 causes the rotational movement of the drive wheel 60 and as such the movement member 50. Ensuing the foot pedal 90 being positioned so as to be adjacent the base member 13, a user of the hands free golf ball washer 100 will release engagement of the foot pedal 90 wherein the retention wheel 120 will retract the drive cable 80 back thereinto and as such continue the rotational movement of the drive wheel 60 and as such the movement member 50 in order to advance a golf ball therealong. The retention wheel 120 is a spring biased wheel that retracts the cable extracted therefrom ensuing release of pressure on the foot pedal 90 providing the aforementioned reverse rotational movement. While the retention wheel 120 is utilized in the preferred embodiment of the present invention, it should be understood within the scope of the present invention that the drive wheel 60 could be operated in an clockwise-counterclockwise rotational movement utilizing alternate elements.

While a drive wheel 60, retention wheel 120 and drive cable 80 are illustrated and discussed herein wherein the aforementioned are operable to provide rotational movement of the movement member 50 within the housing 20, it is contemplated within the scope of the present invention that the movement member 50 could be operated by alternate techniques such as but not limited to a foot switch operated electric motor. It should further be understood within the scope of the present invention that the drive cable 80 is secured to the foot pedal 90 utilizing suitable durable hardware and could further be embodied as a belt, chain or similar element. The foot pedal 90 is hingedly secured to mount 97 utilizing suitable techniques. It should be understood within the scope of the present invention that the foot pedal 90 could be hingedly secured to the base member 13 or a mount 97 having an alternate structure.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A hands free golf ball washer comprising:

a support frame, said support frame having a lower portion and an upper portion;

a housing, said housing having a first end and a second end, said housing having an interior volume, said interior volume of said housing being hollow, said housing being secured to said support frame, said housing having a first aperture and a second aperture, said first aperture being proximate said first end of said housing, said second aperture being proximate said second end of said housing;

a movement member, said movement member being rotatably mounted within the interior volume of said housing, said movement member extending substantially intermediate the first end of said housing and said second end of said housing, wherein said movement member is configured to operably traverse a golf ball from said first end to said second end of said housing;

a drive assembly, said drive assembly being operably coupled to said movement member, said drive assembly operable to provide rotational movement of said movement member.

2. The hands free golf ball washer as recited in claim 1, wherein said first aperture further includes an extension member contiguously formed therewith, said extension member extending upward from said first aperture.

3. The hands free golf ball washer as recited in claim 2, wherein said drive assembly further has mounted therein a drive wheel, said drive wheel being operably coupled to said movement member.

4. The hands free golf ball washer as recited in claim 3, and further including a foot member, said foot member being operably coupled to said drive assembly, said foot member configured to provide a user interface to operate said drive assembly.

5. The hands free golf ball washer as recited in claim 4, wherein said housing is cylindrical in shape and placed in a horizontal orientation.

6. The hands free golf ball washer as recited in claim 5, wherein said movement member is an auger style blade.

7. The hands free golf ball washer as recited in claim 6, wherein said housing further has a plurality of bristles secured thereto, said bristles mounted so as to propagate into the interior volume of said housing.

8. A golf ball washer that is configured to be placed on a golf course wherein the golf ball washer is operated without a need for engagement by hands of a user wherein the golf ball washer comprises:

a support pole member, said support pole member having a first end and a second end, said support pole member being secured to a base member proximate said second end of said support pole member;

a housing, said housing being secured to said support pole member distal to said base member, said housing having an interior volume, said interior volume being hollow, said housing having a first end and a second end, said housing having a first aperture and a second aperture, said first aperture being located at a top area of said housing;

a movement member, said movement member being rotatably mounted within the interior volume of said housing, said movement member configured to traverse a golf ball between said first end of said housing and said second end of said housing, said movement member having a shaft wherein the shaft of the movement member further includes a helical blade mounted therearound extending along said shaft;

a drive assembly, said drive assembly being mounted to said housing, said drive assembly having a housing, said drive assembly having a drive wheel disposed therein, said drive wheel being operably coupled to said movement member so as to provide rotational movement thereof.

9. The golf ball washer configured to be placed on a golf course as recited in claim 8, and further including a drive cable, said drive cable operably coupled to said drive wheel, said drive cable having a portion extending outward from said drive assembly.

10. The golf ball washer configured to be placed on a golf course as recited in claim 9, and further including a foot pedal, said foot pedal being hingedly secured to said base member, said foot pedal being operably coupled with said drive cable.

11. The golf ball washer configured to be placed on a golf course as recited in claim 10, wherein said foot pedal is hingedly secured to said lower portion of said support frame.

12. The golf ball washer configured to be placed on a golf course as recited in claim 11, wherein said drive assembly further includes a retention wheel, said retention wheel configured to store and dispense the drive cable.

13. The golf ball washer configured to be placed on a golf course as recited in claim 12, wherein said retention wheel biasly secures therein the drive cable and provides retraction thereof ensuing a portion of the drive cable being extracted from the retention wheel.

14. The golf ball washer configured to be placed on a golf course as recited in claim 13, and further including a ball trap member, said ball trap member being formed with said housing at said second aperture of said housing, said ball trap member operable to receive the golf ball as the golf ball egresses from the second aperture.

15. A golf ball washer configured to be placed on a golf course and is structured so as to allow a golf to clean a golf ball without engaging the golf ball washer with their hands wherein the golf ball washer comprises:

a support pole member, said support pole member having a first end and a second end, said support pole member being secured to a base member proximate said second end of said support pole member, said base member being planar in manner extending outward circumferentially around said support pole member;

a housing, said housing being secured to said support pole member, said housing being cylindrical in shape, said housing having an interior volume, said interior volume being hollow, said housing having a first end and a second end, said housing having a first aperture and a second aperture, said first aperture being located at a top area of said housing, said first aperture having extension member contiguously formed therewith, said extension member extending upward from said first aperture;

a movement member, said movement member being rotatably mounted within the interior volume of said housing, said movement member configured to traverse a golf ball between said first end of said housing to said second end of said housing, said movement member having a shaft wherein the shaft of the movement member further includes a helical blade mounted therearound extending along said shaft;

a drive assembly, said drive assembly having a drive assembly housing, said drive assembly housing having a cavity, said drive assembly housing being sealably mounted to said housing, said drive assembly housing having a drive wheel disposed within said cavity; and a drive cable, said drive cable operably coupled to said drive wheel.

16. The golf ball washer configured to be placed on a golf course as recited in claim 15, wherein said drive assembly further includes a retention wheel, said retention wheel configured to store a portion of said drive cable, said retention wheel biasly operating said drive cable so as to provide an extension and retraction thereof.

17. The golf ball washer configured to be placed on a golf course as recited in claim 16, and further including a foot pedal, said foot pedal being operably coupled to said drive cable, said foot member configured to provide a user interface to operate said drive assembly.

18. The golf ball washer configured to be placed on a golf course as recited in claim 17, wherein said foot pedal is hingedly secured to said base member, said foot pedal configured to be moved in an upwards downwards movement.

19. The golf ball washer configured to be placed on a golf course as recited in claim 18, and further including bristle support ring members, said bristle support ring members being circumferentially disposed on said housing, said bristle support ring members having a plurality of bristles extending into the interior volume of said housing so as to engage the golf ball.

20. The golf ball washer configured to be placed on a golf course as recited in claim 19, and further including a ball trap member, said ball trap member being formed with said housing at said second aperture of said housing, said ball trap member operable to receive the golf ball as the golf ball egresses from the second aperture.

* * * * *